US006880250B1

(12) United States Patent
Tamez

(10) Patent No.: US 6,880,250 B1
(45) Date of Patent: Apr. 19, 2005

(54) LETTER OPENER

(76) Inventor: Elias Tamez, P.O. Box 532, Mabton, WA (US) 98935

( * ) Notice: Subject to any disclaimer, the term of this patent is extended or adjusted under 35 U.S.C. 154(b) by 0 days.

(21) Appl. No.: 10/465,196

(22) Filed: Jun. 18, 2003

(51) Int. Cl.[7] ..... B26B 29/00
(52) U.S. Cl. ..... 30/293; 30/2; 30/162
(58) Field of Search ..... 30/289, 280, 278, 30/291, 294, 286, 162, 2, 293, 394, DIG. 3, DIG. 4; D8/102, 20, 65, 98, 103–105, 2, 63; 40/649, 653, 642, 661

(56) References Cited

U.S. PATENT DOCUMENTS

| | | | | | |
|---|---|---|---|---|---|
| 73,674 | A | * | 1/1868 | Timby | 30/155 |
| 497,133 | A | * | 5/1893 | Ropes | 30/152 |
| 1,254,208 | A | * | 1/1918 | Cunningham | 30/155 |
| 1,748,376 | A | * | 2/1930 | Anderson | 30/47 |
| 2,266,916 | A | * | 12/1941 | Steele | 30/294 |
| 2,404,141 | A | * | 7/1946 | Jennings | 30/162 |
| 2,814,111 | A | * | 11/1957 | Jones | 30/294 |
| 2,978,808 | A | * | 4/1961 | Reed | 30/293 |
| 3,025,598 | A | * | 3/1962 | Nissen | 30/162 |
| 3,619,902 | A | * | 11/1971 | Fleury | 30/294 |
| 3,855,700 | A | * | 12/1974 | Gerson et al. | 30/162 |
| 4,135,300 | A | * | 1/1979 | Bradley | 30/293 |
| 4,447,950 | A | * | 5/1984 | Mizelle | 30/155 |
| 4,803,782 | A | * | 2/1989 | Lok | 30/294 |
| 4,873,767 | A | * | 10/1989 | Lok | 30/278 |
| D327,209 | S | * | 6/1992 | Takigawa | D8/103 |
| D329,183 | S | * | 9/1992 | Lage et al. | D8/102 |
| D341,307 | S | * | 11/1993 | Lage et al. | D8/103 |
| D342,008 | S | * | 12/1993 | Lage et al. | D8/103 |
| D355,108 | S | * | 2/1995 | Lage et al. | D8/103 |
| 5,433,004 | A | * | 7/1995 | Thompson et al. | 30/169 |
| D364,547 | S | * | 11/1995 | Lage | D8/103 |
| D380,366 | S | * | 7/1997 | Schnidt | D8/103 |
| D387,967 | S | * | 12/1997 | Visconti | D8/102 |
| 6,003,181 | A | * | 12/1999 | Wenk | 7/160 |
| 6,101,721 | A | * | 8/2000 | Medhurst | 30/125 |
| 6,473,974 | B1 | * | 11/2002 | Ireland | 30/279.6 |
| 6,571,477 | B1 | * | 6/2003 | Mothena et al. | 30/115 |
| 6,574,871 | B1 | * | 6/2003 | Visconti et al. | 30/294 |

OTHER PUBLICATIONS

Eromos (http://www.(http://www.epromos.com/ProductIndex/BrowseCategory.jhtm, Aug.–2002, 4 pages.*
WestSky (http://www.westsky.com/letter–openers.htm), 4 pages.*

* cited by examiner

*Primary Examiner*—Allan N. Shoap
*Assistant Examiner*—Ghassem Alie
(74) *Attorney, Agent, or Firm*—Johnson & McCollom, P.C.

(57) ABSTRACT

A letter opener includes a main body section and a retractable section having a retaining piece that moves inside the main body section and a cutting arm coupled to the retaining piece configured to insert into a letter when the retaining section is in an extended position and configured to sit against the main body section when the retaining piece is in a retracted position. The letter opener can include a novelty shape formed from the main body section. The novelty shape can include a baseball cap, a basketball, a car, or a football helmet, among others.

10 Claims, 5 Drawing Sheets

32

32
15
12
32

32

32

32

LETTER OPENER

BACKGROUND

Letter openers have a sharp cutting edge. When not in use, this sharp edge can unintentionally cut other objects and possibly cut a person. Further, existing letter openers are relatively non-descript and provide little aesthetically pleasing appeal. The present invention addresses this and other problems associated with the prior art.

SUMMARY OF THE INVENTION

A letter opener includes a main body section and a retractable section having a retaining piece that moves inside the main body section and a cutting arm coupled to the retaining piece configured to insert into a letter when the retaining section is in an extended position and configured to sit against the main body section when the retaining piece is in a retracted position. The letter opener can include a novelty shape formed from the main body section. The novelty shape can include a baseball cap, a basketball, a car, or a football helmet, among others.

DETAILED DESCRIPTION

Figure 1:
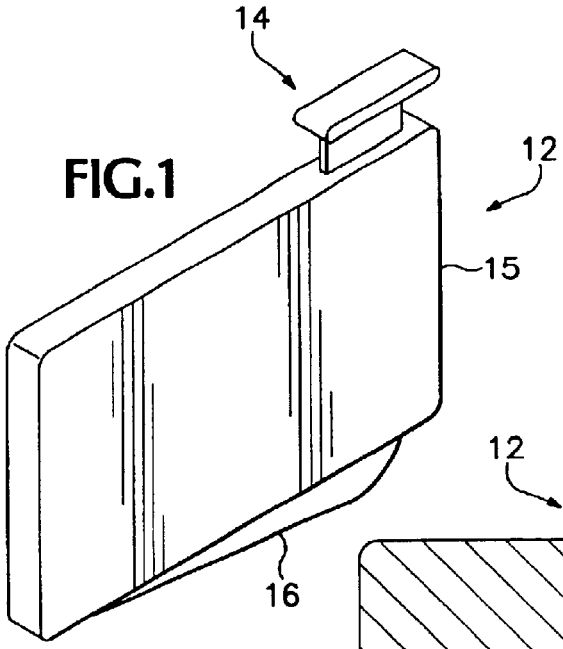
FIG. 1 is a perspective view of a retractable letter opener.
Figure 2:
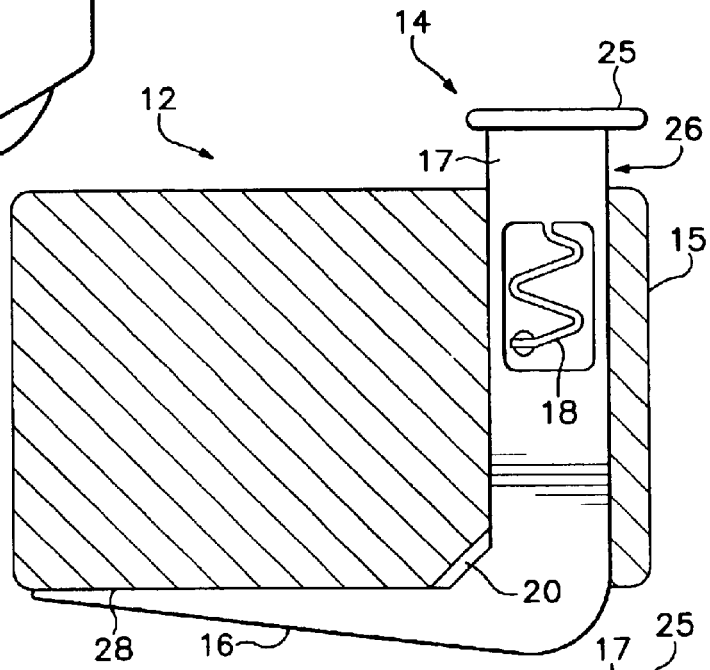
FIG. 2 is a front section view of the letter opener shown in FIG. 1 in a retracted operating position.

FIG. 1 shows a letter opener 12 that includes a main body section 15 and a retractable section 14. FIG. 2 is a side section view showing the letter opener 12 in a retracted position.

Figure 3:
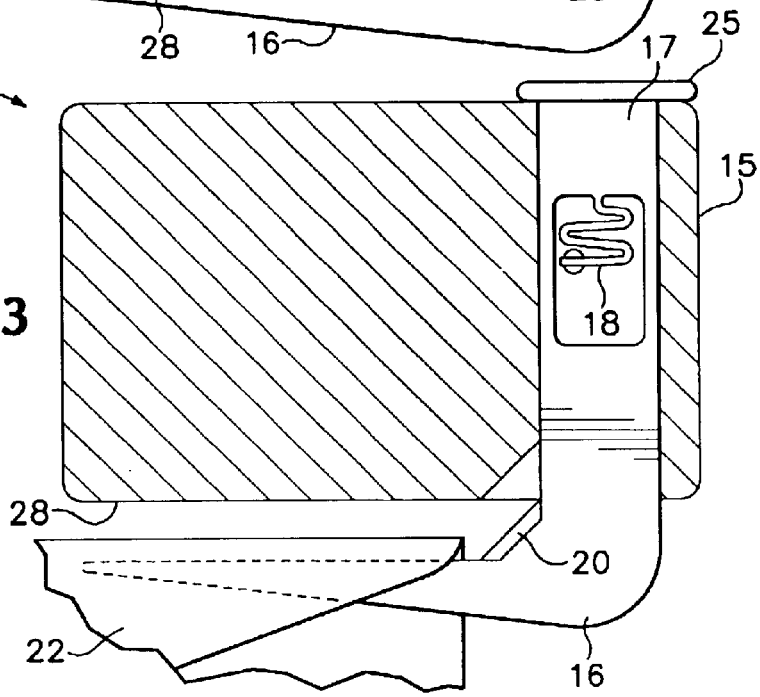
FIG. 3 is a front section view of the letter opener in an extended operating position.
Figure 4:
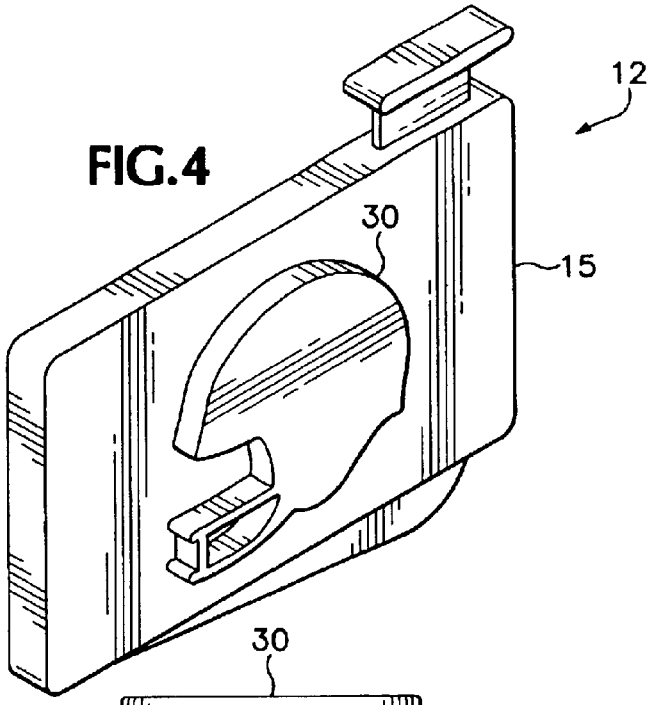
FIG. 4 is perspective view of a helmet shaped letter opener.

FIG. 3 is a side section view showing the letter opener 12 in an extend ed position.

The retractable section 14 includes a retaining piece 17 that moves inside the main body section 15 and a cutting arm 16 coupled to the retaining piece 17. The cutting arm 16 is configured to insert into a letter 22 as shown in FIG. 3 when the retaining section is in the extended position and configured to sit against a bottom edge 28 of the main body section 15 when the retaining piece 17 is in the retracted position shown in FIG. 2.

A spring mechanism 18 is formed in the/retaining piece 17 and elastically couples the retaining piece 17 to the main body section 15. The spring 18 maintains an extended position when the retaining piece 17 is in the retracted position shown in FIG. 2 and maintains a compressed condition when the retaining piece 17 is in the extended position shown in FIG. 3.

The retractable section 14 has a tendency to maintain itself in the retracted position shown in FIG. 2. In order to move the letter opener into the extended position shown in FIG. 3, an operator would press down on the top piece 25. The pressure fit of the main body ection 15 against the sides of the retaining piece 17 can hold the retractable section 14 in the extended position shown in FIG. 3.

In an alternative embodiment, a slot 26 in the main body section 15 is sized so the retaining piece 17 loosely fits inside. In this embodiment, the operator must continuously apply pressure to the top piece 25 in order for the retractable section 14 to stay in the extended position shown in FIG. 3. This improves the safety of the letter opener 12 by keeping a cutting edge 20 retracted inside the main body section as shown in FIG. 2.

In one embodiment, the cutting edge is a metal cutting piece that extends between the retaining piece 17 and the cutting arm 16. In one embodiment, the main body section 15 and the retractable section 14 are both made of plastic.

The main body section 15 is a rectangular shape and the retaining piece 17 slides up and down along an entire height of the main body section 15 through slot 26. The cutting arm 16 extends perpendicular to the retaining piece 17 parallel with a bottom edge 28 of the main body section 15.

Figure 8:
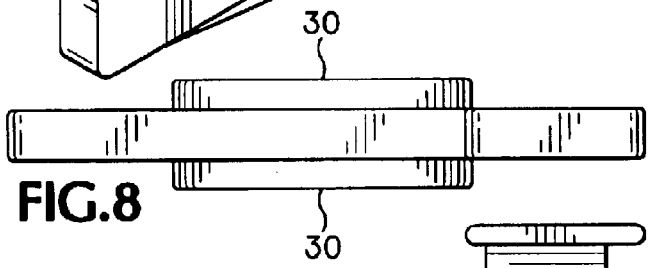
FIG. 8 is a top plan view of the helmet shaped letter opener.
Figure 6:
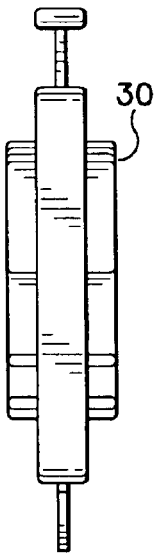
FIG. 6 is a side elevation view of the helmet shaped letter opener, the opposite side view being a mirror image of the front elevation view.
Figure 5:
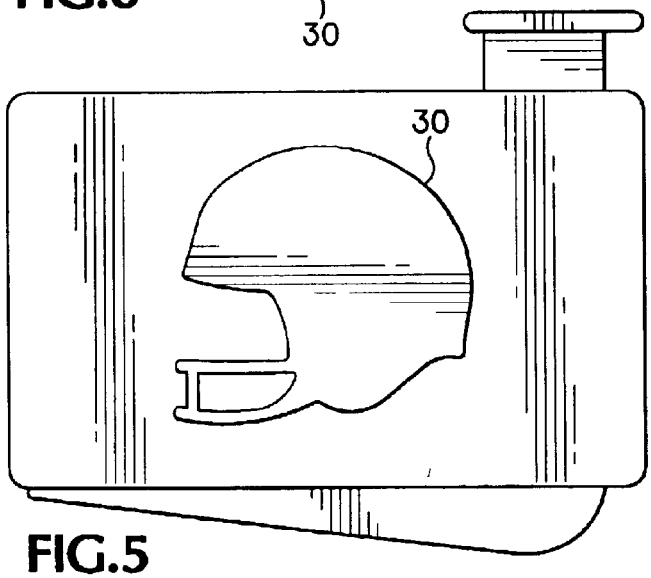
FIG. 5 is a side view of the helmet shaped letter opener.
Figure 7:
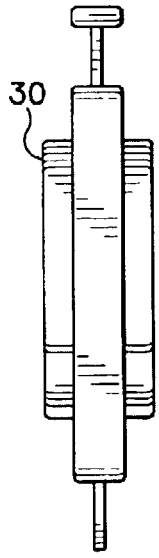
FIG. 7 is a rear elevation view of the helmet shaped letter opener.
Figure 9:
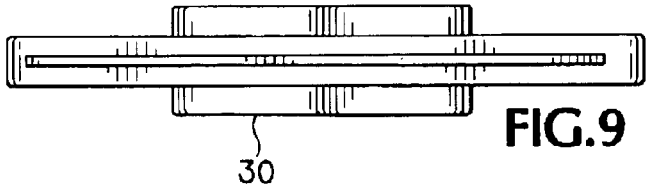
FIG. 9 is a bottom plan view of the helmet shaped letter opener.

FIG. 5 is a side plan view of the helmet shaped letter opener. FIG. 6 is a front elevation view of the helmet shaped letter opener. A rear elevation view being a mirror image of the front elevation view. FIG. 7 is a rear elevation view of the helmet shaped letter opener. FIG. 8 is a top plan view of the helmet shaped letter opener. FIG. 9 is a bottom plan view of the helmet shaped letter opener.

Figures 10, 11, 12, 13, 14:
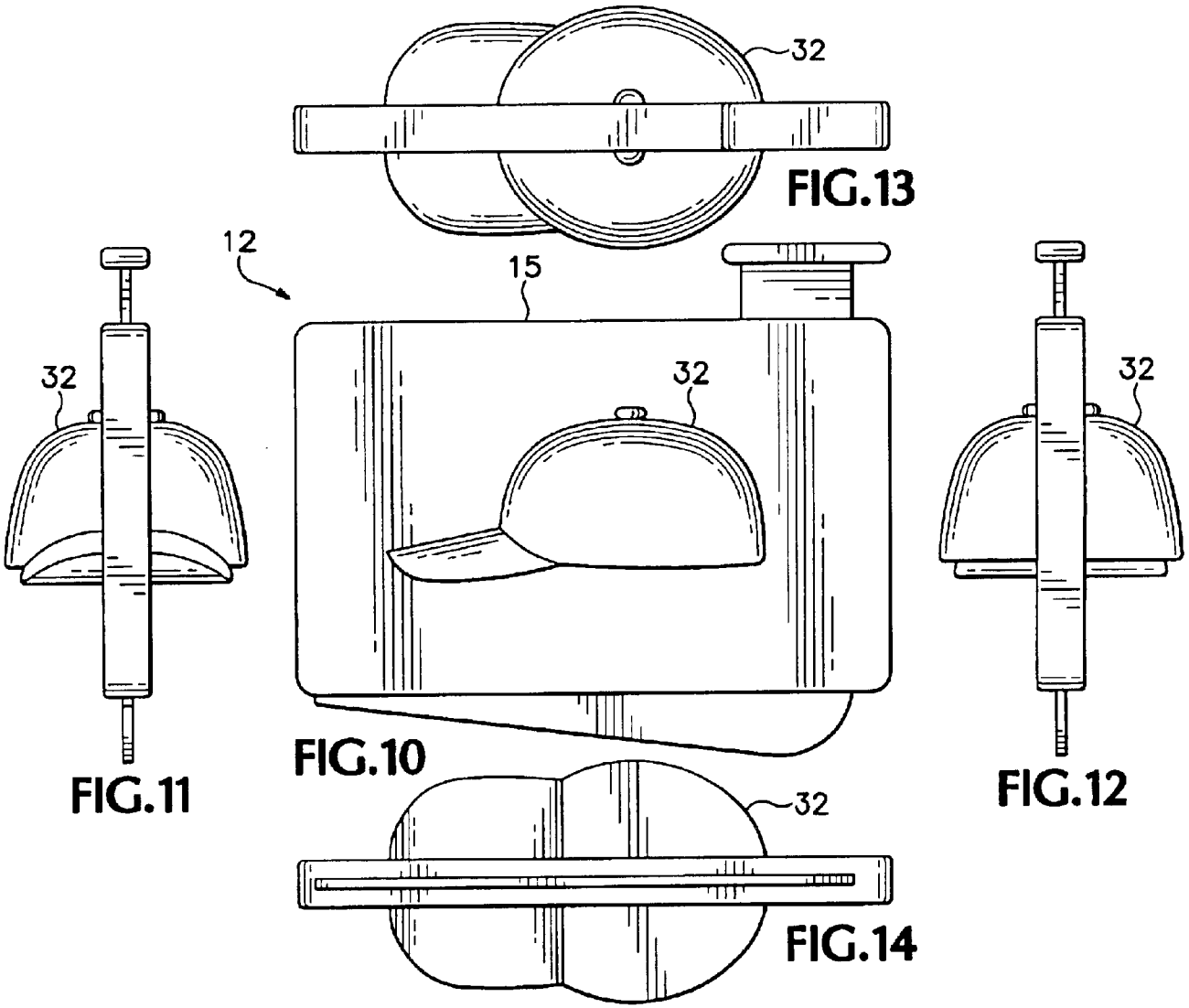
FIG. 10 is a front side view of a baseball cap shaped letter opener, an opposite side elevation view being a mirror image of the front elevation view.
FIG. 11 is a front elevation view of the baseball cap shaped letter opener.
FIG. 12 is a rear elevation view of the baseball cap shaped letter opener.
FIG. 13 is a top plan view of the baseball cap shaped letter opener.
FIG. 14 is a bottom plan view of the baseball cap shaped letter opener.

FIG. 10 is a side view of a baseball cap shaped letter opener, a rear elevation view being a mirror image of the front elevation view. FIG. 11 is a front elevation view of the baseball cap shaped letter opener. FIG. 12 is a rear elevation view of the baseball cap shaped letter opener. FIG. 13 is a top plan view of the baseball cap shaped letter opener. FIG. 14 is a bottom plan view of the baseball cap shaped letter opener.

Figures 15, 16, 17, 18, 19:
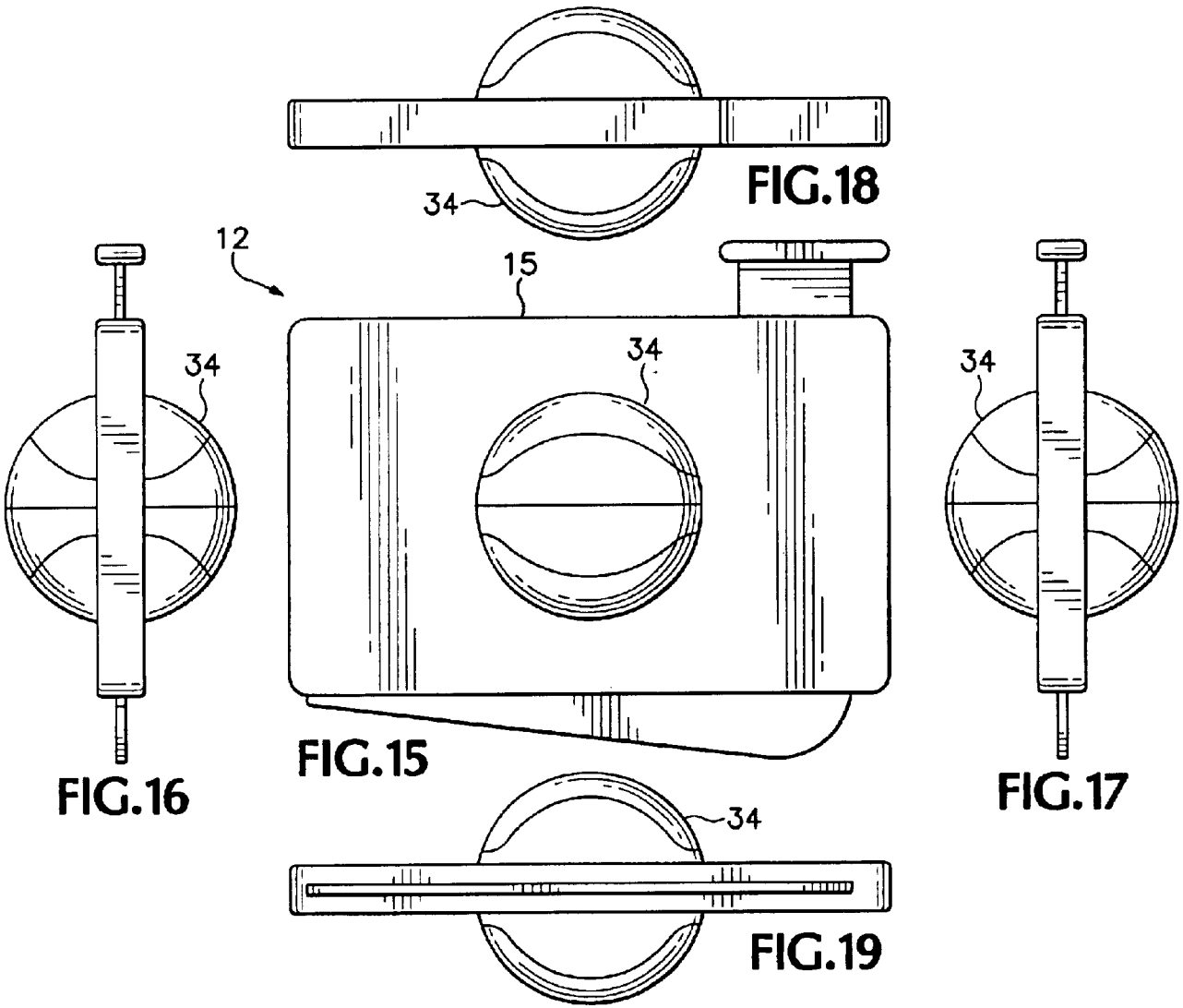
FIG. 15 is a front side view of a basketball shaped letter opener, a rear side elevation view being a mirror image of the front elevation view.
FIG. 16 is a front elevation view of the basketball shaped letter opener.
FIG. 17 is a rear elevation view of the basketball shaped letter opener.
FIG. 18 is a top plan view of the basketball shaped letter opener.
FIG. 19 is a bottom plan view of the basketball shaped letter opener.

FIG. 15 is a side view of a basketball shaped letter opener, a rear elevation view being a mirror image of the front elevation view. FIG. 16 is a front elevation view of the basketball shaped letter opener.

FIG. 17 is a rear elevation view of the basketball shaped letter opener. FIG. 18 is a top plan view of the basketball shaped letter opener and FIG. 19 is a bottom plan view of the basketball shaped letter opener.

Figures 20, 21, 22, 23, 24:
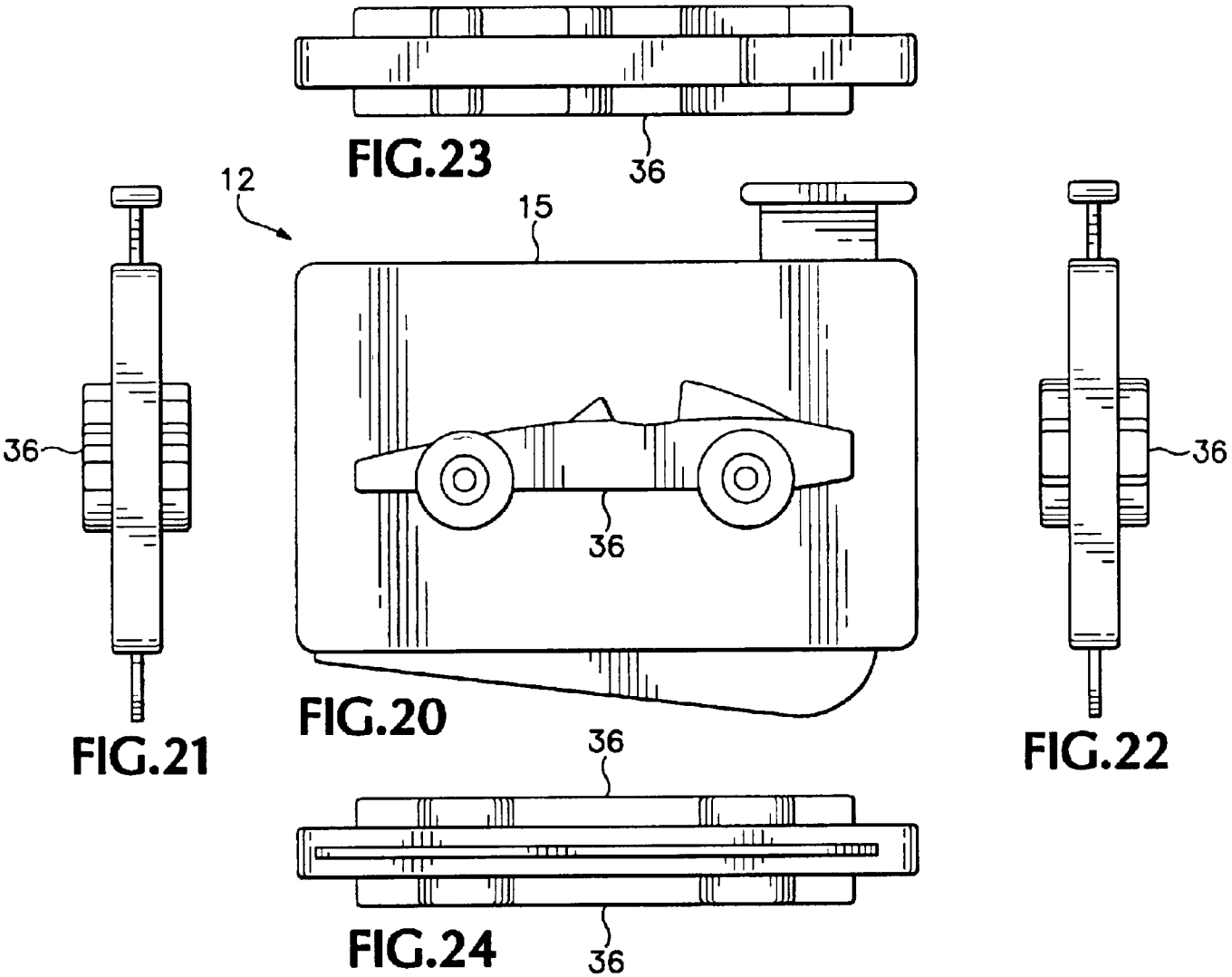
FIG. 20 is a side elevation view of a car shaped letter opener, an opposite side elevation view being a mirror image of the front elevation view.
FIG. 21 is a front elevation view of the car shaped letter opener.
FIG. 22 is a rear elevation view of the car shaped letter opener.
FIG. 23 is a top plan view of the car shaped letter opener.
FIG. 24 is a bottom plan view of the car shaped letter opener.

FIG. 20 is a side view of a car shaped letter opener, an opposite side view being a mirror image of the front elevation view. FIG. 21 is a front elevation view of the car shaped letter opener. FIG. 22 is a rear elevation view of the car shaped letter opener. FIG. 23 is a top plan view of the car shaped letter opener and FIG. 24 is a bottom plan view of the car shaped letter opener.

The letter opener 12 in FIGS. 4–9 includes a football helmet shaped portion 30 extending from the main body section. The letter opener 12 in FIGS. 10–14 include a baseball cap shaped portion 32 extending from the main body section 15. The letter opener 12 in FIGS. 15–19 include a basketball shaped portion 34 extending from the main body section 15. The letter opener 12 in FIGS. 20–24 include a car shaped portion 36 extending from the main body section 15.

Having described and illustrated the principles of the invention in a preferred embodiment thereof, it should be apparent that the invention may be modified in arrangement and detail without departing from such principles. I claim all modifications and variation coming within the spirit and scope of the following claims.

What is claimed is:

1. A letter opener, comprising:

a main body section including an elongated bottom edge; and a retractable section having a retaining piece that moves inside the main body section and a cutting arm coupled to the retaining piece, the cutting arm having an elongated top edge that abuts up against the elongated bottom edge of the main body section when the retaining piece is in non-extended position and configured to move downward away from the main body while maintaining a parallel relationship between the bottom edge of the main body section and the top edge of the cutting arm when in an extended position, the cutting arm further configured to insert into a letter when the retaining section is in the extended position;

wherein the retractable section retaining piece includes a top piece that extends from a top edge of the main body section, a center piece that extends from a top edge of the main body section, through the main body section, and through the bottom edge of the main body section and including a metal cutting piece that extends between the retaining piece and the cutting arm.

2. A letter opener, comprising:

a main body section including an elongated bottom edge; and a retractable section having a retaining piece that moves inside the main body section and a cutting arm coupled to the retaining piece, the cutting arm having an elongated top edge that abuts up against the elongated bottom edge of the main body section when the retaining piece is in a non-extended position and configured to move downward away from the main body while maintaining a parallel relationship between the bottom edge of the main body section and the top edge of the cutting arm when in an extended position, the cutting arm further configured to insert into a letter when the retaining section is in the extended position;

wherein the main body section is a rectangular shape and the retaining piece slides up and down along an entire height of the main body section and the cutting arm extends perpendicular to the retaining piece parallel with a bottom edge of the main body section.

3. A letter opener, comprising:

a main body section including an elongated bottom edge;

a retractable section having a retaining piece that moves inside the main body section and a cutting arm coupled to the retaining piece, the cutting arm having an elongated top edge that abuts up against the elongated bottom edge of the main body section when the retaining piece is in a non-extended position and configured to move downward away from the main body while maintaining a parallel relationship between the bottom edge of the main body section and the top edge of the cutting arm when in an extended position, the cutting arm further configured to insert into a letter when the retaining section is in the extended position; and a football helmet shaped portion projecting outwardly from both sides of the main body section to form together a football helmet.

4. A letter opener, comprising;

a main body section including an elongated bottom edge;

a retractable section having a retaining piece that moves inside the main body section and a cutting arm coupled to the retaining piece, the cutting arm having an elongated top edge that abuts up against the elongated bottom edge of the main body section away from the main body while maintaining a parallel relationship between the bottom edge of the main body section and the top edge of the cutting arm when in an extended position, the cutting arm further configured to insert into a letter when the retaining section is in the extended position; and a baseball cap shaped portion projecting outwardly from both sides of the main body section to form together a baseball cap.

5. A letter opener, comprising;

a main body section including an elongated bottom edge;

a retractable section having a retaining piece that moves inside the main body section and a cutting arm coupled to the retaining piece, the cutting arm having an elongated top edge that abuts up against the elongated bottom edge of the main body section when the retaining piece is in a non-extended position and configured to move downward away from the main body while maintaining a parallel relationship between the bottom edge of the main body section and the top edge of the cutting arm when in an extended position, the cutting arm further configured to insert into a letter when the retaining section is in the extended position; and a basketball shaped portion projecting outwardly from both sides of the main body section to form together a basketball.

6. A letter opener, comprising;

a main body section including an elongated bottom edge;

a retractable section having a retaining piece that moves inside the main body section and a cutting arm coupled to the retaining piece, the cutting arm having an elongated top edge that abuts up against the elongated bottom edge of the main body section when the retaining piece is in a non-extended position and configured to move downward away from the main body while maintaining a parallel relationship between the bottom edge of the main body section and the top edge of the cutting arm when in an extended position, the cutting arm further configured to insert into a letter when the retaining section is in the extended position; and a car shaped portion projecting outwardly from both sides of the main body section to form together a car.

7. A letter opener, comprising;

a main body section including a flat elongated bottom edge; and a retractable section having a retaining piece that moves inside the main body section and a cutting arm coupled to the retaining piece, the cutting arm having an elongated top edge that abuts up against the flat elongated bottom edge of the main body section when the retaining piece is in a non-extended position and configured to move downward away from the main body while maintaining a parallel relationship between the bottom edge of the main body section and the top edge of the cutting arm until moved into an extended position, the cutting arm further configured to insert into a letter when the retaining section is in the extended position, wherein a football helmet shaped portion projecting outwardly from both sides of the main body section to form together a football helmet.

8. A letter opener, comprising:

a main body section including a flat bottom edge; and a retractable section having a retaining piece that moves inside the main body section and a cutting arm coupled to the retaining piece, the cutting arm having an elongated top edge that abuts up against the flat elongated bottom edge of the main body section when the retaining piece is in a non-extended position and configured to move downward away from the main body while maintaining a parallel relationship between the bottom edge of the main body section and the top edge of the cutting arm until moved into an extended position, the cutting arm further configured to insert into a letter when the retaining section is in the extended position, wherein a baseball cap shaped portion projecting outwardly from both sides of the main body section to form together a baseball cap.

9. A letter opener, comprising:

a main body section including a flat elongated bottom edge; and a retractable section having a retaining piece that moves inside the main body section and a cutting arm coupled to the retaining piece, the cutting arm having an elongated top edge retaining piece is in a non-extended position and configured to move downward away from the main body while maintaining a parallel relationship between the bottom edge of the main body section and the top edge of the cutting arm until moved into an extended position, the cutting arm further configured to insert into a letter when the retaining section is in the extended position, wherein a basketball shaped portion projecting outwardly from both sides of the main body section to form together a basketball.

10. A letter opener, comprising:

a main body section including a flat elongated bottom edge; and a retractable section having a retaining piece that moves inside the main body section and a cutting arm coupled to the retaining piece, the cutting arm having an elongated top edge that abuts up against the flat elongated bottom edge of the main body section when the retaining piece is in a non-extended position and configured to move downward away from the main body while maintaining a parallel relationship between the bottom edge of the main body section and the top edge of the cutting arm until moved into an extended position, the cutting arm further configured to insert into a letter when the retaining section is in the extended position, wherein a car shaped portion projecting outwardly from both sides of the main body section to form together a car.

* * * * *

UNITED STATES PATENT AND TRADEMARK OFFICE

CERTIFICATE OF CORRECTION

PATENT NO. : 6,880,250 B1
APPLICATION NO. : 10/465196
DATED : April 19, 2005
INVENTOR(S) : Elias Tamez It is certified that error appears in the above-identified patent and that said Letters Patent is hereby corrected as shown below:

At column 2, line 18, please replace “extended ed position.” with --extended position--

At column 2, line 27, please replace “the/retaining” with --the retaining--

At column 2, line 38, please replace “ection 15” with --section 15--

At column 3, line 47, please replace “in non-extended” with --in a non-extended--

At column 4, line 50, please replace “comprising;” with --comprising:--

At column 5, line 1, please replace “comprising;” with --comprising:--

At column 5, line 17, please replace “comprising;” with --comprising:--

At column 5, line 37, please replace “flat bottom edge;” with --flat elongated bottom edge;--

At column 6, line 15, please replace “top edge retaining” with --top edge that abuts up against the flat elongated bottom edge of the main body section when the retaining--

Signed and Sealed this

Seventeenth Day of October, 2006

JON W. DUDAS
*Director of the United States Patent and Trademark Office*